United States Patent [19]

Walsh et al.

[11] Patent Number: 4,831,420

[45] Date of Patent: May 16, 1989

[54] COPIER/DOCUMENT HANDLER CUSTOMER VARIABLE REGISTRATION SYSTEM

[75] Inventors: Frank R. Walsh, Webster; Ernest L. DiNatale, Rochester; Thomas W. Morgan, Macedon, all of N.Y.

[73] Assignee: Xerox Corporation, Stamford, Conn.

[21] Appl. No.: 145,153

[22] Filed: Jan. 19, 1988

[51] Int. Cl.[4] ..... B65H 9/00; B65H 9/04; G03G 15/00

[52] U.S. Cl. ..... 355/203; 355/317; 271/226; 271/255

[58] Field of Search ..... 355/6, 3 SH, 14 SH, 355/77; 198/394; 271/226, 227, 253, 255

[56] References Cited

U.S. PATENT DOCUMENTS

| | | | |
|---|---|---|---|
| 4,248,528 | 2/1981 | Sahay | 355/14 R |
| 4,438,917 | 3/1984 | Janssen et al. | 271/227 |
| 4,511,242 | 4/1985 | Ashbee et al. | 355/14 C |
| 4,519,700 | 5/1985 | Barker et al. | 355/3 SH |
| 4,627,721 | 12/1986 | Nguyen et al. | 355/77 |
| 4,711,552 | 12/1987 | Nilsson et al. | 355/14 SH X |

FOREIGN PATENT DOCUMENTS

| | | | |
|---|---|---|---|
| 0035304 | 3/1980 | Japan | 355/77 |

OTHER PUBLICATIONS

Newcomb et al., IBM Technical Disclosure Bulletin, Mar. 1973, vol. 15, No. 10.

*Primary Examiner*—A. T. Grimley
*Assistant Examiner*—Robert Beatty

[57] ABSTRACT

A system for setting or adjusting the proper registration position of the original document in a copier having a document feeder providing a variable document registration position on the platen, and numeric data key entries programmable in specialized diagnostic modes, and non-volatile memory. The system involves registering and copying a test sheet using the document feeder in its initial, unadjusted, registration setting. The test sheet has a test pattern of registration position indicia with identifying numeric indicia, and also having a registration window at an optically reversed position on the test sheet from the test pattern and a cursor pointing to a specific position within the window. The test sheet is laid over a same-size copy of the test sheet, with the sheet edges aligned, but with the two sheets rotated by 180 degrees relative to one another, so that the copy of the test pattern on the copy sheet underlies and is visible through the registration window of the test sheet, whereby the cursor on the test sheet points to a specific registration identifying numeric indicia within the test pattern copy. By activating a selected diagnostics mode of the copier and then entering the identifying numeric indicia into the numeric data key entries of the copier the copier automatically resets in non-volatile memory the registration position of the document feeder by a preprogrammed distance corresponding to the entered numeric indicia.

5 Claims, 3 Drawing Sheets

COPIER/DOCUMENT HANDLER CUSTOMER VARIABLE REGISTRATION SYSTEM

The present invention relates to copier registration, and, more particularly, to an automatic registration system for a copier with a document handling system using a customer usable test pattern registration adjustment system.

Disclosed herein is a system of adjusting a copier document feeder registration with a special master test sheet providing both registration marks and a copy registration reading template. Registration is simply accomplished by making a copy of the master sheet, comparing the superposed master and copy sheet to read a correction factor datum from a copied registration mark appearing at the registration reading template, and entering that datum in the copier controller to effect correction.

This process enables a copier with an attachable document handler to be assembled and set up by the customer, without requiring the normal setup and initial registration adjustment by a "tech rep". It is particularly suitable for direct sales of small copiers with accessories shipped directly to the customer as separately shipped components.

The known prior art includes Xerox Corporation U.S. Pat. No. 4,627,721 issued Dec. 9, 1986 to T. A. Nguyen et al, which utilizes a test pattern placed by the operator on the copier platen to determine the optimum position of the optical components for focus and magnification ratios after the tech rep has visually inspected sample copies of the test pattern and entered adjustment numbers on the control console as noted in Col. 2, 2nd paragraph, for example. The use of test patterns on a copier per se, for different purposes, is well known, as demonstrated by this reference. However, typically, as exemplified by this reference, the process involved is relatively complicated and involves considerable interaction by the tech rep (a copier manufacturer representative) and is not a process which is intended to be, or suitable for, use by the purchaser or operator of the copier.

Art of particular interest is IBM U.S. Pat. No. 4,511,242 issued Apr. 16, 1985 to William H. Ashbee, et al. The abstract indicates that electronic alignment of paper feeding components in a copier is achieved by copying an original master with vernier calibrations onto a target master with other vernier calibrations which is placed in the copy paper tray. The machine is operated to copy the original master onto the copy master to produce a double or overlapping set of vernier calibrations on the copy or target master, which, when compared, provide information relating to skew angle, side edge relationship and leading edge alignment of the image to the copy paper. The vernier calibrations provide data which are keyed into a microprocssor control copy feeding servo mechanism to correct copy paper position and remove misalignment. (Note that, in contrast to the present system, two separate masters are required, one for the original and one for a special copy sheet, which special sheet must be substituted for a regular, blank paper, copy sheet, whereas the present system utilizes regular copy sheets and only one master is required.)

Further by way of background, Janssen U.S. Pat. No. 4,438,917 and Barker U.S. Pat. No. 3,519,700 pertain to automatic registration adjustment of the document feed, and Sahay U.S. Pat. No. 4,248,528 uses a marked master sheet read in a document handler by a special indicator optical scanner to control copying functions.

Difficulties in automatic document handling systems in general are discussed hereinbelow. These difficulties include the criticality of document registration and the need for increased automation and operator simplification especially with current increases in document handling speeds.

As xerographic and other copiers increase in speed, and become more automatic, it is increasingly important to provide higher speed yet more reliable and more automatic handling of the document sheets being copied, i.e. the input to the copier. It is desirable to feed, accurately register, and copy document sheets of a variety or mixture of sizes, types, weights, materials, conditions and susceptibility to damage, yet with minimal document jamming, wear or damage by the document transporting and registration apparatus, even if the same documents are automatically fed and registered repeatedly, as for recirculating document precollation copying.

The art of original document sheet handling for copiers has been intensively pursued in recent years. Various systems have been provided for automatic or semiautomatic feeding of document sheets to and over the imaging station of the copier for copying. The documents are normally fed over the surface of an imaging station comprising a transparent platen, into a registered copying position on the platen, and then off the platen. Such automatic or semiautomatic document handlers eliminate the need for the operator to place and align each document on the platen by hand. This is a highly desirable feature for copiers. Document handlers can automatically feed documents as fast as they can be copied, which cannot be done manually with higher speed copiers, thus enabling the full utilization or productivity of higher speed copiers.

A preferable document handling system is one that utilizes an existing or generally conventional copier optical imaging system, including the external transparent copying window (known as the platen or imaging station) of the copier. It is also desirable that the document handling system be readily removable, as by pivoting away, to alternatively allow the copier operator to conventionally manually place documents, including books, on the same copying platen. Thus, a lighter weight document handler is desirable. It is also desirable that a document registration edge alignment or positioning system be available for such manual copying which is compatible with that used for the document handler.

One of the most difficult to achieve features for automatic document handling is the rapid, accurate, reliable, and safe registration of each document at the proper position for copying. Conventionally the document is desirably either center registered or corner registered (depending on the copier) by the document handler automatically at a preset registration position relative to the copier platen. At this registration position two orthogonal edges of the document are aligned with two physical or positional (imaginary) registration lines of the copier platen at which the original document is properly aligned with the copier optics and copy sheet/photoreceptor registration system for correct image transfer of the document image to the photoreceptor and then to the copy sheet. This registration accuracy is desirably consistently within approximately one millimeter. If the document is not properly registered, then undesirable dark borders and/or edge shadow images may appear on the ensuing copy sheet, or information near an edge of the document may be lost, i.e. not copied onto the copy sheet. Document misregistration, especially skewing, can also adversely affect further feeding and/or restacking of the documents.

In preferred types of copying systems the document is registered for copying overlying a selected portion of full sized (full frame) platen which is at least as large as the largest document to be normally copied automatically. In such systems the document is preferably either scanned or flashed while it is held stationary on the platen in the desired registration position. That is, in these full frame systems the document is preferably registered by being stopped and held during imaging at a preset position over the platen glass which is adjacent one side or edge thereof.

As shown in the art, and further discussed below, document handling systems have been provided with various document transports to move the documents over the copier platen and into registration. Such document platen transports may comprise single or plural transport belts or feed wheels, utilizing frictional, vacuum, or electrostatic sheet driving forces. Various combinations of such transports are known with various registration devices or systems. Preferably the same platen transport sheet feeder is used to drive a document onto and off of the platen before and after copying as well as registering the document.

The cited art shows several approaches to registering a document for copying at an appropriate position relative to the transparent copying window. Typically the document is registered on one axis by driving it with a platen transport against a mechanical gate or stop positioned temporarily or permanently at or adjacent one edge of the platen. This is often at or closely adjacent the downstream edge of the platen. That allows unidirectional movement of the document across the platen, entering from the upstream side or edge closely following the proceeding document and ejecting after copying from the downstream side or edge of the platen. The registration gate or stop may comprise projecting aligned fingers, or roller nips, or a single vertical surface along one registration line, against which an edge of the sheet, preferably the leading edge, is driven into abutment to mechanically stop and thereby register the sheet on one axis, in its principal direction of movement. Another function of such mechanical registration is to also deskew the document, i.e., to properly rotate and align it with registration line as well as to determine and control its registration position. However, such a mechanical gate cannot be interposed in the path of a continuous web document and thus cannot be used for intemediate registration thereof.

As disclosed, for example, in U.S. Pat. Nos. 4,043,665 issued Aug. 23, 1977 to J. R. Caldwell; 4,132,401 issued Jan. 2, 1979 to J. F. Gauranski, et al; or U.S. Pat. Nos. 4,295,737 or 4,391,505 issued Oct. 20, 1981 and July 5, 1983 to Morton Silverberg, document registration can desirably be done without mechanical document stops on the platen. This can be done by preregistering the document to a platen transport belt and then moving the document a known, preset, distance over the platen on the belt into registration, providing there is no slippage during this entire movement between the document and the belt. Alternatively, this can be done by sensing, on the platen or upstream of the platen, with a document edge sensor, the edge of a document being transported onto the platen and then stopping the document platen transport then or after a preset time period or movement to stop the document on the platen. Off-platen document edge sensing (see below) is preferred, since reliable on-platen sensing is more difficult and generally requires special sensors and platen transport modifications or adaptations such as disclosed in the U.S. Pat. No. 4,391,505 and in U.S. Pat. No. 3,473,035 and U.S. Pat. No. 3,674,363. Thus, U.S. Pat. No. 3,674,363 to E. O. Baller et al, issued July 4, 1972, e.g. Cols. 8 and 9, second paragraph, and Col. 10, first paragraph, discloses sensing the document trail edge upstream of the platen to initiate slowdown and stopping of the platen transport. The U.S. Pat. No. 3,473,035, issued Oct. 14, 1969 to J. F. Gardner, is noted as to SW1 in FIG. 7 and its description regarding operator selectable document stopping/shifted imaging positions. A recent measured-stop registration system, for an RDH, is taught in U.S. Pat. No. 4,579,444 issued Apr. 1, 1986 to T. S. Pinckney and H. J. Sanchez.

The following additional references also apparently sense a document sheet trailing edge as the reference time for initiating a control "count" or fixed distance drive for controlling the document sheet feeding drive on the copier platen: IBM Tech. Discl. Vol. 19, No. 5, Oct. 1976, pp. 1589–1591, and U.S. Pat. Nos. 3,829,083 and 3,936,041, to Shiina et al (Ricoh), and 4,066,255 issued Jan. 3, 1978 to W. F. Bradbury (Addressograph-Multigraph Corp.), and Xerox Disclosure Journal publications Vol. 2, No. 3, May/June 1977, p. 49, and Vol. 3, No. 2, March/April 1978, pp. 123–124.

Further examples of U.S. Patents on servo-motor or stepper-motor driven original document feeders in general are U.S. Pat. Nos. 3,888,579; 4,000,943; 4,144,550; 4,283,773 and 4,455,018.

In some document handling systems a system for also side registering (laterally positioning) the document on the platen is used, i.e. aligning the original on both axes while on the platen, e.g. U.S. Pat. Nos. 4,411,418 or 4,335,954. However two axes on-platen registration is not required, and such lateral or second axis registration may be done upstream of the platen, as by confinement of the documents within the side guides in the document tray from which the documents are fed, or driving the sheet against a side guide, e.g. U.S. Pat. Nos. 4,257,587; 4,266,762 or 4,381,893.

In the description herein the term "document" or "sheet" refers to a usually flimsy sheet of paper, plastic, or other such conventional individual image substrate, and not to microfilm or electronic images which are generally much easier to manipulate. It is important to distinguish electronic copying systems, such as the Xerox "9700" printer, which read and store images of documents electronically and create copies by writing on a photoreceptor with a laser beam, or the like, since they do not have the document handling problems dealt with here.

The "document" here is the sheet (original or previous copy) being copied in the copier onto the outputted "copy sheet", or "copy". Related plural sheets of documents or copies are referred to as a "set". A "simplex" document or copy sheet is one having an image and "page" on only side or face of the sheet, whereas a "duplex" document or copy sheet has a "page", and normally an image, on both sides.

The present invention is particularly suitable for precollation copying, i.e. automatically plurally recirculated document set copying provided by a recirculating document handling system or "RDH". However, it also has applicability to nonprecollation, or postcollation, copying, such as postcollation operation of an RDH or semiautomatic document handling (SADH) as discussed above. Postcollation copying, or even manual document placement, is desirable in certain copying situations, even with an RDH, to minimize document handling, particularly for delicate, valuable, thick or irregular documents, or for a very large number of copy sets. Thus, it is desirable that a document handler for a precollation copying system be compatible with, and alternatively usable for, postcollation and manual copying as well.

Some examples of Xerox Corporation RDH U.S. Patents are U.S. Pat. No. 4,459,013 issued July 10, 1984 to T. J. Hamlin et al; U.S. Pat. No. 4,278,344 issued July 14, 1981 to R. B. Sahay; and U.S. Pat. No. 4,579,444, 325 or 326. Some other examples of recirculating document handlers are disclosed in U.S. Pat. Nos. 4,076,408; 4,176,945; 4,428,667; 4,330,197; 4,466,733 and 4,544,148. A preferred vacuum corrugating feeder air knife, and a tray, for an RDH, are disclosed in U.S. Pat. Nos. 4,418,905 and 4,462,586. An integral semi-automatic and computer form feeder (SADH/CFF), which may be an integral part of an RDH, as noted in Col. 2, paragraph 2, therein, is disclosed in U.S. Pat. No. 4,462,527. Various others of these patents, such as U.S. Pat. No. 4,176,945 above, issued Dec. 4, 1979 to R. Holzhauser (Kodak) teach plural mode, e.g. RDH/SADH, document handlers.

The present invention overcomes various of the above-discussed and other problems, and provides various of the above features and advantages.

A feature of the specific embodiment disclosed herein is to provide an improved system for setting or adjusting the proper registration position of an original document on the platen of a copier having a document feeder providing a variable document registration position on said platen, and numeric data key entries programmable in specialized diagnostic modes, comprising said steps of: inserting a test sheet into said document feeder of said copier and registering said test sheet using said document feeder in its initial, unadjusted, registration setting; the test sheet having a pattern of registration position indicia, and identifying numeric indicia directly associated with respective said registration indicia, defining a test pattern; the test sheet also having a registration window therethrough, and a cursor pointing to a specific position within said registration window, said registration window being at an optically reversed position on said test sheet from said test pattern; making a same size copy of said test sheet with a visible copy of said test pattern thereon on regular ordinary copy paper in said copier with said test sheet in said initial registration setting; overlaying said test sheet over said copy of said test sheet, with the edges of said two sheets aligned with one another, but with said two sheets rotated by 180 degrees relative to one another, so that said visible copy of said test pattern on said copy sheet underlies and is visible through said registration window of said test sheet and whereby said cursor on said test sheet points to a specific said registration position and identifying numeric indicia on said test pattern copy visible through said registration window; recording said specific test pattern numeric indicia on said copy shown through said registration window to which said cursor on said test sheet points; activating a selected said diagnostics mode of said copier; and entering said identifying numeric indicia into said numeric data key entries of said copier in a said programable diagnostics mode so that said copier automatically adjusts and resets said registration position of a document on said copier provided by said document feeder by a registration adjustment distance corresponding to said numeric indicia entered therein.

Further features provided by the system disclosed herein, individually or in combination, include those for a system for copier registration adjustment using a test sheet master which is copied at the imaging station of a copier to produce a copy test sheet from said test sheet master, which copy test sheet is overlay registered and compared with said test sheet master to provide a registration misalignment indicia spaced along a direction of misregistration movement; said test sheet master also having a misregistration measurement window in a different area of said test sheet master spaced from said test pattern area; said registration measurement window and said test pattern areas respectively occupying opposing areas of said test sheet master in defined positions such that when a copy sheet of said test sheet master is overlay aligned with said test sheet master a copy of at least a portion of said test pattern area on the copy sheet will be visible in said registration measurement window in said test sheet master; said test sheet master also having a cursor indicator thereon pointing to a specific position within said registration window so as to point to a specific said registration misalignment indicia visible in said registration window; preferably wherein said identifiable registration misalignment indicia comprise spaced lines with associated respective different identifying numbers, said lines being spaced apart by increments along a registration measurement axis corresponding to said preset increment distances corresponding to a predetermined misregistration adjustment setting; and preferably wherein said respective preset distances correspond to respective programable registration stopping positions of a document by a document feeder at the imaging station of a copier.

Further disclosed features include a system for copier imaging station registration adjustment comprising a copier with a document feeder with an electronically variable programable document imaging station registration position and with numeric data key entry, and a test sheet master adapted to be fed by said document feeder and copied at the imaging station of said copier registered by said document feeder to produce a copy test sheet from said test sheet master, which may be overlay registered and compared with said test sheet master to provide a registration misalignment indicia; said test sheet master having a test pattern area comprising a series of plural but specifically numerically indentifiable registration misalignment indicia spaced along a direction of misregistration movement of said document feeder; said test sheet master also having a misregistration measurement window in a different area of said test sheet master spaced from said test pattern area; said registration measurement window and said test pattern areas respectively occupying substantially equal but opposing corner areas of said test sheet master in defined positions such that when the copy sheet of said test sheet master is overlay aligned with said test sheet master said copy of at least a portion of said test pattern area on the copy sheet will be visible in said registration measurement window in said test sheet master; said test sheet master also having a cursor indicator thereon pointing to a specific position within said registration window so as to point to a specific said numeric registration misalignment indicia visible in said registration window; and said copier being electronically programable by entering said specific numeric registration misalignment indicia into said numeric data key entry of said copier so that said copier automatically varies and resets said document registration position of a document provided by said document feeder by a registration adjustment distance corresponding to said numeric registration misalignment indicia entered therein.

Some examples of various other prior art copiers with document handlers, and especially with control systems therefor, including document sheet detecting switches, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in this art, and in general, how to program and execute document handler and copier control functions and logic with conventional or simple software instructions for conventional microprocessors. This is taught by the above and other patents and various commercial copiers. Such software may vary depending on the particular function and particular microprocessor or microcomputer system utilized, of course, but will be available to or readily programmable by those skilled in the applicable arts without experimentation from either descriptions or prior knowledge of the desired functions together with general knowledge in the general software and computer arts. It is also known that conventional or specified document handling functions and controls may be alternatively conventionally provided utilizing various other known or suitable logic or switching systems.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below. The present invention will be better understood by reference to this description of this embodiment thereof, including the drawing figures (approximately to scale), wherein.

There is disclosed herein an automatic registration system for a copier with a customer usable test pattern used to generate mating test copies providing a misregistration indicia. The system disclosed herein comprises adjusting an automatic document feeder registration position by copying a master sheet having registration lines thereon, overlaying and aligning the master sheet and that copy sheet, comparing a reading marker on the superposed master with registration lines on the copied sheet to read a correction factor, and entering that correction factor to effect correction.

Figure 1:
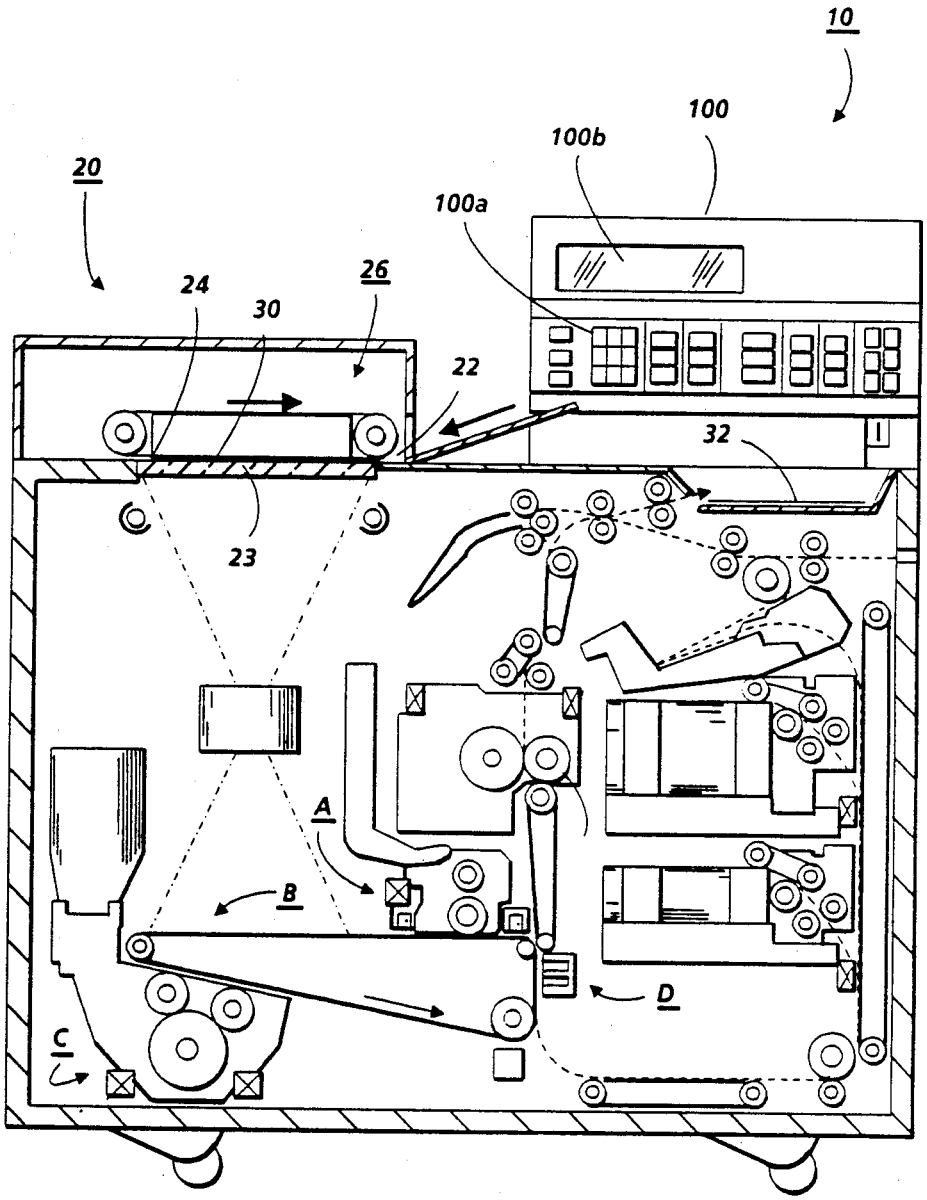
FIG. 1 is a schematic side view of an exemplary document handler and copier with which the system of the invention may be utilized (in this example, the document handler is a simple servo-registered SADH)

Describing now in further detail the specific example illustrated in the Figures, there is schematically shown in FIG. 1 an exemplary copier 10, with an exemplary document handling system (DH) 20, with a document input 22. The system disclosed herein is applicable to various copiers and DH's. The copier 10 may be of any known type, such as those disclosed in above-cited copier patents. The exemplary DH 20 illustrated here may be similar to those described in various above-cited patents on variable stepper motor or servo motor registration DH's (Non-mechanical-stop DH's).

The DH 20 provides for automatically transporting individual document sheets onto and over the conventional platen imaging station 23 of the copier 10, using a belt platen transport 26 overlying the platen 23. Documents are inputted to one end of the platen transport 26 from the document input 22, which may be adjacent one side of the platen 23, and is shown at the right side of the DH 20 here. That document input 22 may be referred to herein as an SADH input, although it is not limited to semiautomatic input feeding. This SADH input 22 may be also used for larger documents, optionally inserted short edge first, or CF web, or an automatic document stack stack feeder (ADF). The inputted document is fed by the DH 20 platen transport 26 a preset registration feed distance to a registration position 24 on the platen 23, where the document is temporarily stopped for copying, then ejected.

As is conventionally practiced, the entire document handler unit 20 pivotally mounts to the main portion or base of the copier so as to be liftable by the operator up away from the platen for manual doument placement and copying or jam clearance of documents jammed in the platen area.

The exemplary copier 10 may be any xerographic or other copier, as illustrated and described in various patents cited above, or otherwise. The exemplary copier 10 may conventionally include a photoreceptor belt and the conventional xerographic stations acting thereon for respectively cleaning and charging (A), image exposing (B), image developing (C), image transfer (D) etc.. Documents on the platen 23 may be conventionally imaged onto the photoreceptor through an optical imaging system to fit the document images to the copy sheets. That image is transferred (D) from the photoreceptor to the copy sheet after its development.

The control of all document and copy sheet feeding and other copier functions is, conventionally, by the machine controller 100. The controller 100 is preferably a known programmable microprocessor, exemplified by the previously cited art. It includes conventional programable non-volatile memory capacity. The controller 100 conventionally controls all of the machine steps and functions described herein including the operations of the document feeder 20, the document and copy sheet gates, the feeder drives, etc.. As further taught in those and other references, the controller 100 also conventionally provides for other selections by the operator through the panel of numeric and other switches **100*a* thereon, including the copy count, time delays, jam correction control, etc.. The controller 100 may also be conventionally connected to receive jam and control signals from various conventional document sheet sensors mounted in the document path of the DH. The controller 100 also preferably has a conventional numeric and diagnostic display 100***b* on the same console or panel as the switches 100*a*. The display 100*b* may be a liquid crystal panel, LED's, or other known copier displays.

Conventionally, the registration of the document sheet and the copy sheet is accomplished using the controller 100 by sensing the leading or trailing edge of the sheets and counting or driving by a fixed distance or equivalent time and/or decreasing or increasing the driving duration by decreasing or increasing the stepper motor drive on-time to provide registration and positional and timing coordination for copying.

In a customer installable system the DH 20 may require local, customer, installation on the copier 10 base unit (known as the copy handling module or CHM). Normally, there will be some initial deviation in registration between the DH and the copier base unit, requiring adjustment. Disclosed here is a "customer transparent" adjustment system or set up aid. No mechanical alignment adjustment is required with the system herein.

The disclosed procedure comprises adjusting the ADF document image lead edge position coincident with the manual or base processor registration. It is performed as part of the ADF installation, or whenever an identified change in ADF registration occurs.

Figure 3:
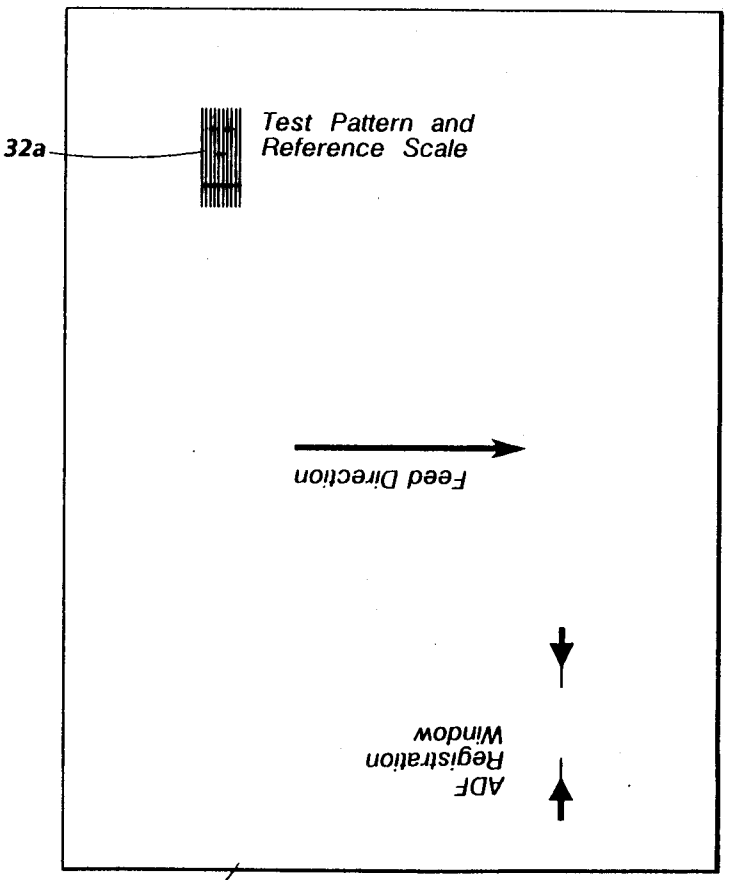
FIG. 3 is a copy of the test sheet of FIG. 2.
Figure 2:
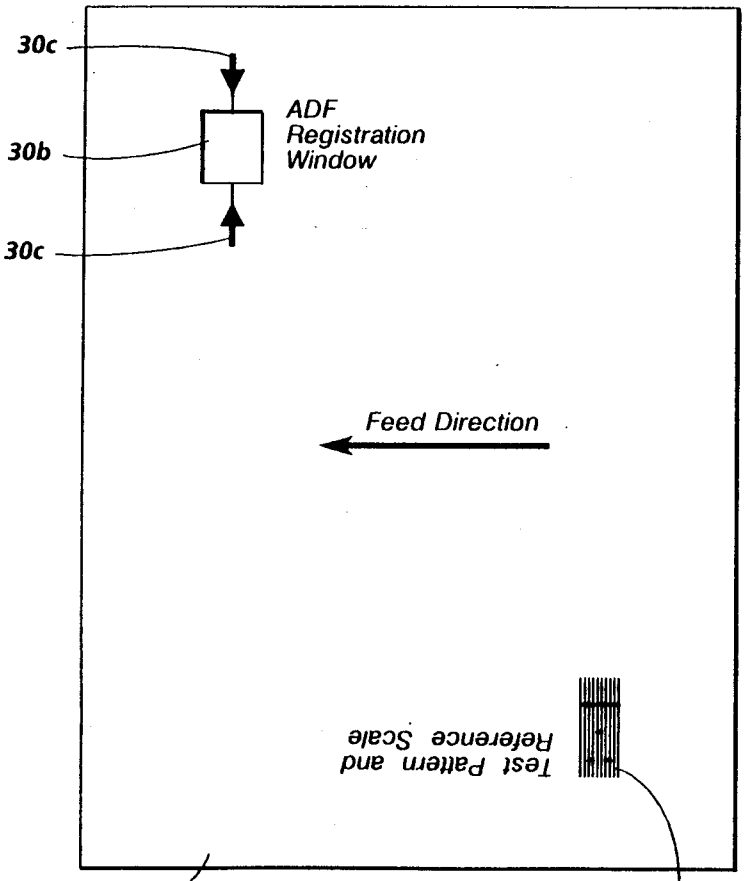
FIG. 2 is a test sheet embodiment.

As shown in FIG. 2 there is provided here a master test sheet 30 with a test pattern or reference scale 30*a*, a registration reading window 30*b*, and an associated reading indicator arrow or other cursor 30*c*. The test sheet 30 is provided with, or as a page of, a manual. Upon installation of the DH unit 20, the customer uses it to make a sample copy 32 of the test sheet 30. The test sheet 30 is fed into the DH 20 and registered and copied thereby as if it were a conventional document sheet. The test pattern 30*a* here includes a regular series of spaced, numbered, lines extending transversely of the registration adjustment axis. (Here, transverse the direction of motion of both the platen transport 32 document path and the copier's copy sheet path.) The test copy sheet 32 shown in FIG. 3 made from the test sheet 30 contains the corresponing, copied, incremental registration test pattern 32*a*, but shifted into a position on the copy sheet 32 corresponding to the degree of misregistration. I.e., the degree of relative test pattern shift of the test pattern copy 32*a* from the original test pattern 30*a* equals the misregistration.

The master sheet window 30*b* is at an equally positioned but opposite corner location from the master sheet test pattern 30*a* so that when the two sheets are overlaid, and the copy sheet 32 edges are aligned with the master test sheet 30 edges, the copy 32*a* of the test pattern 30*a* shows in the window 30*b*. The customer views this test copy 32 area 32*a* within the transparent or open registration window 30*b* overlay. The edge of window 30*b* has arrows 30*c* which now will point to a particular one of the numbered test pattern lines 32*a* on the underlying copy sheet 32 in the center of the window 30*b*. The number pointed to indicates the degree of misregistration. The customer keys this misregistration information number into non volatile memory (NVM) in the copier controller 100 after conventionally putting the controller into a "diagnostics" mode. This entered data permanently adjusts a stepper or servo motor drive setting for the DH to correct registration. That is, the number read from the overlaid copy sheet may be entered into the DH registration program through the copier control panel numerical switches 100*a*. The entered information may directly correspond to a number of clock counts for operation (preset distance feeding and stopping) of the DH stepper motor. With this adjustment entered, the controller 100 will operate the stepper motor accordingly from then on, or until registration is reset again.

This is a simple method of adjusting for process direction registration variances that may occur in the automatic document handler or paper handling system. This method is shown here incorporated in the ADH accessory registration system. However, it may easily be adapted to the paper registration system. This concept is applicable to control over the entire paper path.

To accomplish a customer installation a simplified method is needed to vary DH lead-edge registration to compensate for any deviation between the base processor and the DH. Using the DH stepper motor logic control, this simple customer test pattern/registration guide and customer accessible non-volitile memory reprograming system for the DH drive logic resolves this problem.

Figure 4:
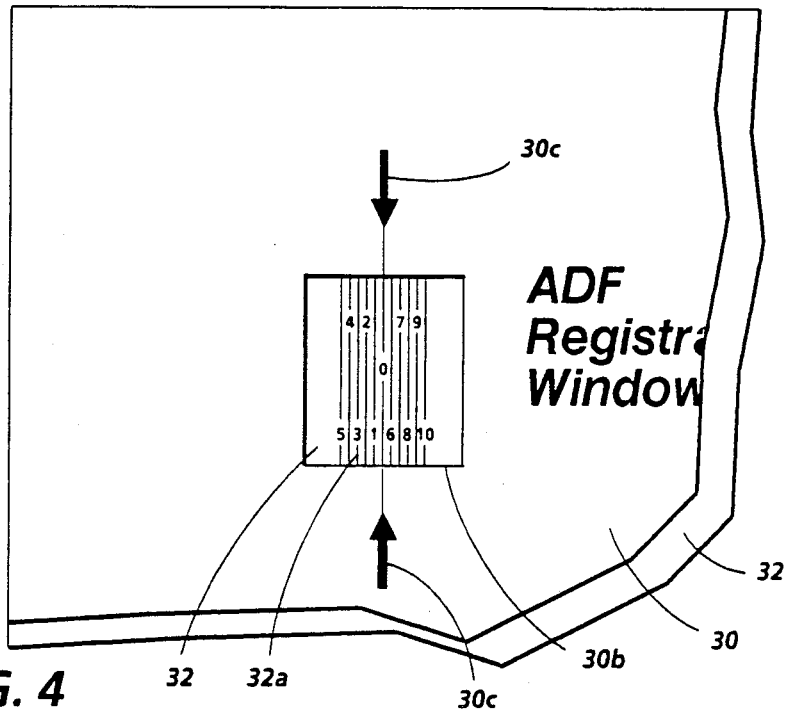
FIG. 4 is an enlarged segment of the test sheet of FIG. 2, (of the registration window test copy reading area) superimposed over the mating segment of the test copy sheet of FIG. 3 made therefrom, showing proper registration.

Basically, this method is transparent to the customer. The test pattern/guide sheet 30 may contain simple instructions, such as those reproduced below, and a test pattern 30*a* of specific incremental spaced registration marks (lines here) which have individual printed registration number assignments, here 1–10. Here these registration numbers equate to positive or negative registration measurements, baselined from a zero ("0") registration point (zero being optimum registration as shown in FIG. 4).

Figure 5:
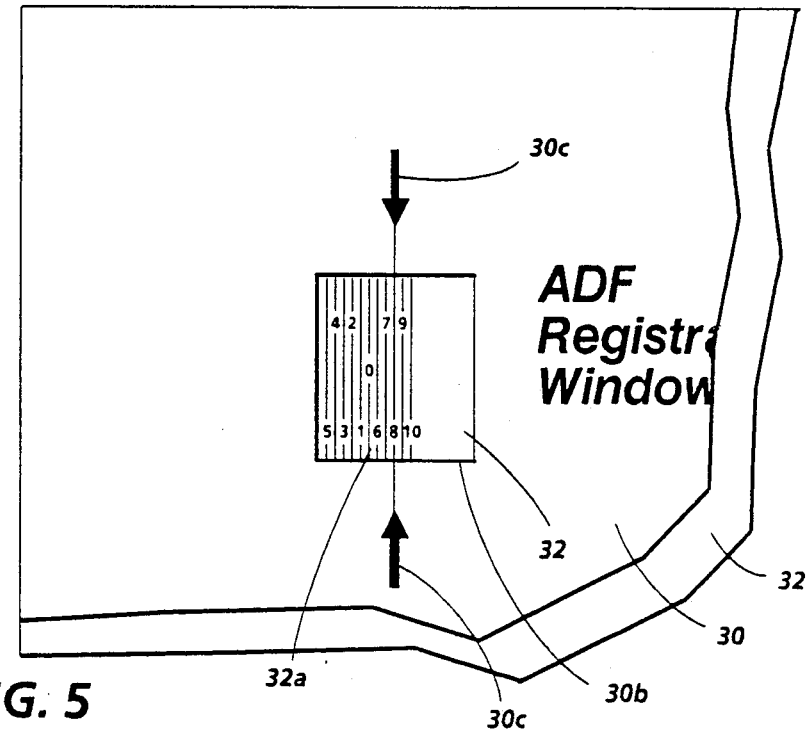
FIG. 5 is otherwise similar to FIG. 4, but shows the test copy sheet having a different registration (a misregistration) in the registration window.

When the customer aligns the sample copy 32 test pattern 32*a* in the registration window 30*b* of the test sheet the registration arrows 30*c* will align with one of these registration line numbers. If the number to which arrow 30*c* points is not 0, as shown in FIG. 5, then the sample copy is indicating a registration error. The amount and direction of misregistration is known by the sample copy registration line number which aligns with the registration arrow 30*c*. The customer enters this in the NVM file to change the DH registration setting to this number. The new NVM setting increases or decreases the stepper motor pulses to advance or delay the document stopping point (registration position) to compensate for the misregistration. (Alternately, the copy sheet registration position could be so changed.)

This system can easily be applied to paper path registration adjustments. A similar customer test pattern can be utilized with a similar paper registration window guide. The test sheet would preferably be manually placed on the platen to be copied in the proper registration position, or fed into registration by the DH 20 after first zeroing the DH registration as described above. The NVM file could have settings which equate to xxx milliseconds delays or advances to turn-on of the copy sheet registration rolls or gate earlier or later than norma. This would allow the paper to enter the system at an optimum time, coincident with the optical image, to correct a mismatch between optical image lead edge and paper lead edge.

The following is an example of instructions which may be printed on the test sheet 30, and/or elsewhere:

Initialization of Automatic Document Feeded (ADF)

1. Locate the test pattern supplied with the ADF and place it face up in the Document Handler.

2. Adjust slide guide and push test pattern into feeder until green light is lit. Press the START button to make a copy.

3. Put the copy behind the sheet that you fed so that you see the numbered lines in the window. Be sure the sheets are aligned evenly.

4. Find the number of the line that lines up with the arrows and write it on the setup document.

5. If the number is zero, the alignment is allright, and you need do nothing more. If the number is other than zero, continue this procedure.

6. Switch off the copier and then switch it on. Wait for the lighted, "Please Wait" message to go off.

7. Press the number 4 on the control panel four times.

8. Press the STOP key. The letter P will show.

9. Press the number 3, and then the number 0; next, press the START key.

10. Press the number recorded in step 4, and then press the START key. The letter P will show.

11. Press STOP.

12. To check what you have done, repeat steps 2 thru 5. This time line number 0 should line up with the arrows. If not, repeat steps 4 thru 12 again.

ADF Registration Set Number Chart (Sample Set Number)

0=good registration
1=Slightly Under Registered
2-5=Under Registered
6=Slightly Over Registered
7-10=Over Registered Typical Calibration Scheme:

Clock Counts Per Calibration No.

| Test Pattern Cal. No. | ADF Stepper Motor MM Dim From "0" | Clock Counts | Total Counts (Range) |
|---|---|---|---|
| 5 | +5 MM | +25 | 365 |
| 4 | +4 MM | +20 | 360 |
| 3 | +3 MM | +15 | 355 |
| 2 | +2 MM | +10 | 350 |
| 1 | +1 MM | +5 | 345 |
| 0 [= 0 Clock Counts from ADF "0" Spec. of 340] | | | |
| 6 | −1 MM | −5 | 335 |
| 7 | −2 MM | −10 | 330 |
| 8 | −3 MM | −15 | 325 |
| 9 | −4 MM | −20 | 320 |
| 10 | −5 MM | −25 | 315 |

Details
5 Clocks = 1 MM
340 Clocks = 68 MM
Total distance of document travel for registration = 68 Mm
× 5 Clocks Per MM
= Total clocks for registration = 340 ± 5 Clocks
Qty. Sel. Indications
0 Sets = 340 ± 5
1 Set = +5 Clocks
1-5 Increments of +5 Clocks each
6 Sets = −5 Clocks
6-10 Increments of −5 Clocks each The registration resetting instructions disclosed herein are merely examples for exemplary copiers and controllers and document handlers. For example, a much simpler, and known, entry system is to provide a separate "diagnostics" button on the copier, which, when pressed, directly puts the copier into a diagnostics mode. Then a predetermined diagnostics control number can be entered on the copy count buttons on the control panel preset for this particular diagnostics routine, followed by entry of the misregistration number recorded from the test copy. Then the "diagnostics" button can be pressed again to store and implement the new registration setting and return the copier to its normal operating mode.

As noted that this exemplary system is implemented for use for document platen registration, but is also usable for copy sheet/photoreceptor registration adjustment, and the same basic process can be used, with a change in the different preprogramed diagnostic mode into which that data is entered, and preferably with manual registration placement of the test sheet document.

While the embodiment disclosed herein is preferred, it will be appreciated from this teaching that various alternatives, modifications, variations or improvements therein may be made by those skilled in the art, which are intended to be encompassed by the following claims:

What is claimed is:

1. An improved system for setting or adjusting the proper registration position of an original document on the platen of a copier having a document feeder providing a variable document registration position on said platen, and numeric data key entries programmable in specialized diagnostic modes, comprising the steps of:

inserting a test sheet into said document feeder of said copier and registering said test sheet using said document feeder in its initial, unadjusted, registration setting;

said test sheet having a pattern of registration position indicia, and identifying numeric indicia directly associated with respective said registration indicia, defining a test pattern;

said test sheet also having a registration window therethrough, and a cursor pointing to a specific position within said registration window, said registration window being at an optically reversed position on said test sheet from said test pattern;

making a same size copy of said test sheet with a visible copy of said test pattern thereon on a blank copy sheet in said copier with said test sheet in said initial registration setting;

overlaying said test sheet over said copy sheet of said test sheet, with the edges of said sheets aligned with one another, but with said sheets rotated by 180 degrees relative to one another, so that said visible copy of said test pattern on said copy sheet underlies and is visible through said registration window of said test sheet and whereby said cursor on said test sheet points to a specific said registration position and identifying numeric indicia on said test pattern copy visible through said registration window;

recording said specific test pattern numeric indicia on said copy shown through said registration window to which said cursor on said test sheet points;

activating a selected said diagnostics mode of said copier;

and entering said identifying numeric indicia into said numeric data key entries of said copier in a said programable diagnostics mode so that said copier automatically adjusts and resets said registration position of a document on said copier provided by said document feeder by a registration adjustment distance corresponding to said numeric indicia entered therein.

2. For a system for copier registration adjustment using a test sheet master which is copied at the imaging station of a copier to produce a copy test sheet from said test sheet master, which copy test sheet is overlay registered and compared with said test sheet master to provide a registration misalignment indicia; a said test sheet master having a test pattern area comprising a series of plural but specifically indentifiable registration misalignment indicia spaced along a direction of misregistration movement; said test sheet master also having a registration measurement window in a different area of said test sheet master spaced from said test pattern area; said registration measurement window and said test pattern areas respectively occupying opposing areas of said test sheet master in defined positions such that when a copy sheet of said test sheet master is overlay aligned with said test sheet master a copy of at least a portion of said test pattern area on the copy sheet will be visible in said registration measurement window in said test sheet master; said test sheet master also having a cursor indicator thereon pointing to a specific position within said registration window so as to point to a specific said registration misalignment indicia visible in said registration window.

3. The test sheet master of claim 2 wherein said identifiable registration misalignment indicia comprise spaced lines with associated respective different identifying numbers, said lines being spaced apart by increments along a registration measurement axis corresponding to preset increment distances corresponding to a predetermined misregistration adjustment setting.

4. The test sheet master of claim 3 wherein said preset distances correspond to respective programable registration stopping positions of a document by a document feeder at the imaging station of a copier.

5. A system for copier imaging station registration adjustment comprising a copier with a document feeder with an electronically variable programable document imaging station registration position and with numeric data key entry, and a test sheet master adapted to be fed by said document feeder and copied at the imaging station of said copier registered by said document feeder to produce a copy test sheet from said test sheet master, which copy test sheet is overlay registered and compared with said test sheet master to provide a registration misalignment indicia; said test sheet master having a test pattern area comprising a series of plural but specifically numerically indentifiable registration misalignment indicia spaced along a direction of misregistration movement of said document feeder; said test sheet master also having a registration measurement window in a different area of said test sheet master spaced from said test pattern area; said registration measurement window and said test pattern areas respectively occupying substantially equal but opposing corner areas of said test sheet master in defined positions such that when the copy sheet of said test sheet master is overlay aligned with said test sheet master at least a portion of said test pattern area on the copy sheet will be visible in said registration measurement window in said test sheet master; said test sheet master also having a cursor indicator thereon pointing to a specific position within said registration window so as to point to a specific said numeric, registration misalignment indicia visible in said registration window; and said copier being electronically programable by entering said specific numeric registration misalignment indicia into said numeric data key entry of said copier so that said copier automatically varies and resets said document registration position of a document provided by said document feeder by a registration adjustment distance corresponding to said numeric registration misalignment indicia entered therein.

* * * * *